US007805911B2

(12) United States Patent
Bassi

(10) Patent No.: US 7,805,911 B2
(45) Date of Patent: Oct. 5, 2010

(54) COVERING MACHINE FOR PACKING BOXES

(75) Inventor: Gino Bassi, Bologna (IT)

(73) Assignee: Emmeci S.p.A., Milan (IT)

( * ) Notice: Subject to any disclaimer, the term of this patent is extended or adjusted under 35 U.S.C. 154(b) by 313 days.

(21) Appl. No.: 11/797,549

(22) Filed: May 4, 2007

(65) Prior Publication Data

US 2007/0256394 A1 Nov. 8, 2007

(30) Foreign Application Priority Data

May 8, 2006 (IT) ..... BO2006A0338

(51) Int. Cl.
*B65B 11/48* (2006.01)

(52) U.S. Cl. ..... 53/206; 53/210; 53/461; 493/95; 493/98; 493/111

(58) Field of Classification Search ..... 53/206, 53/210, 220, 221, 222, 230, 226, 227, 460, 53/461, 464; 493/95, 98, 111, 113
See application file for complete search history.

(56) References Cited

U.S. PATENT DOCUMENTS 690,377 A * 12/1901 Smith ..... 493/389
753,524 A 3/1904 Smith
772,750 A * 10/1904 Smith ..... 493/389
1,185,507 A 5/1916 Hult et al.
1,187,194 A 6/1916 Smith
1,363,025 A * 12/1920 Wagner ..... 493/111
1,402,259 A 1/1922 Smith
1,424,316 A 8/1922 Morrison
1,592,264 A 7/1926 Gooding
1,657,642 A 1/1928 Pouzar
1,692,831 A 11/1928 Hanshe
1,693,136 A 11/1928 Carle
1,829,063 A 10/1931 Seckendorf
1,895,090 A 1/1933 Stokes
2,166,473 A * 7/1939 Wah Lum Ko et al. ..... 53/222
2,246,858 A 6/1941 Phelps
2,574,127 A 11/1951 Silby
2,604,828 A 7/1952 Langdon
2,641,973 A 6/1953 Straw
2,713,813 A * 7/1955 Triolo ..... 493/113
2,750,097 A 6/1956 Moore
2,769,588 A 11/1956 Beck
2,808,693 A 10/1957 Guggenheim
2,867,158 A 1/1959 Andresen, Jr. et al.
3,010,639 A 11/1961 Govatsos
3,104,012 A 9/1963 Beamish
3,119,540 A 1/1964 Schenk et al.

(Continued)

FOREIGN PATENT DOCUMENTS

DE 1611612 A1 1/1971

(Continued)

*Primary Examiner*—Hemant M Desai
(74) *Attorney, Agent, or Firm*—Pearne & Gordon LLP

(57) ABSTRACT

A covering machine for applying a covering sheet on packing boxes, includes a covering cavity for receiving a box joined to a respective covering sheet, and presser elements which can be associated with the box and are able to move between a first, active position in which they apply the respective sheet to the box and a second, extracted position away from the box.

9 Claims, 3 Drawing Sheets

U.S. PATENT DOCUMENTS

| | | | | |
|---|---|---|---|---|
| 3,280,706 | A | 10/1966 | Bradicich et al. | |
| 3,427,784 | A * | 2/1969 | Engeler | 53/172 |
| 3,492,784 | A | 2/1970 | Williams et al. | |
| 3,657,976 | A | 4/1972 | Fish | |
| 3,802,280 | A | 4/1974 | Shelmire | |
| 4,072,226 | A | 2/1978 | Richards et al. | |
| 4,194,441 | A | 3/1980 | Williams et al. | |
| 4,280,810 | A | 7/1981 | Struble | |
| 4,292,102 | A | 9/1981 | Bidegain | |
| 4,510,735 | A * | 4/1985 | Cillario | 53/464 |
| 4,844,327 | A | 7/1989 | Pausing | |
| 5,044,547 | A | 9/1991 | Hartman | |
| 5,632,713 | A | 5/1997 | Canning et al. | |
| 5,802,806 | A * | 9/1998 | Scaliti | 53/226 |
| 6,029,884 | A | 2/2000 | Roeland | |
| 6,588,175 | B1 | 7/2003 | Gaudenzi | |
| 7,007,792 | B1 | 3/2006 | Burch | |
| 2005/0288164 | A1 * | 12/2005 | Calugi | 493/475 |

FOREIGN PATENT DOCUMENTS

| | | | |
|---|---|---|---|
| EP | 0011550 | A1 | 5/1980 |
| EP | 0038488 | A2 | 10/1981 |
| EP | 0685329 | A2 | 12/1995 |
| EP | 1609585 | A1 | 12/2005 |
| FR | 2330533 | A1 | 6/1977 |
| GB | 325741 | A | 2/1930 |
| IT | 1224973 | | 10/1990 |
| IT | 1269105 | | 12/1995 |
| IT | FI940110 | A1 | 12/1995 |
| WO | 2007129201 | A2 | 11/2007 |
| WO | 2008090455 | A2 | 7/2008 |

* cited by examiner

COVERING MACHINE FOR PACKING BOXES

BACKGROUND OF THE INVENTION

The present invention relates to a covering machine for packing boxes, in particular for covering boxes with a covering sheet on which glue has already been applied.

There are prior art so called "covering machines" for joining an erected box and a covering sheet to which glue was previously applied.

Examples of such machines were the subject matter of patents IT1224973 and IT1269105 by the same Applicant.

Such machines have a movement system with which the box is transported to a covering unit which applies the sheet on which glue has already been applied to the walls of the box to complete box covering.

The boxes are brought to the covering unit already joined to the respective covering sheet. In this situation, the box rests on the central portion of the inner surface of the covering sheet on which glue has already been applied, and with the respective opening facing upwards.

Covering machines have a mould, supported by respective movement elements which move the mould vertically. In this way, when the box joined to the respective covering sheet is brought to the covering unit, the mould is moved downwards and inserted in the box to push it into a forming cavity in which the covering sheet is applied to the walls of the box.

Covering machines also have rollers or brushes on the edges which form the forming cavity, designed to make contact with the outer surface of the covering sheet which is in contact with the corresponding walls of the box.

During the mould return stroke, the covered box is stopped by extractors which engage the box, allowing it to be removed from the mould. The covering machine then moves the box towards other processing stations.

However, prior art covering machines have the important disadvantage of not being suitable for covering "narrow" boxes, that is to say, boxes with small transversal dimensions.

Said disadvantage is mainly due to the dimensions of the mould movement and supporting elements, which must at least partly enter the forming cavity so that the box can be covered completely.

In this situation it should be noticed that the brushes or rollers which form the inlet edge of the forming cavity must be suitably spaced to allow said movement elements to pass between them.

Consequently, boxes with dimensions less than the minimum distance between the brushes, corresponding to the minimum dimensions of the movement elements, cannot be covered.

SUMMARY OF THE INVENTION

The aim of the present invention is therefore to overcome the above-mentioned disadvantage by providing a covering machine for packing boxes which is highly flexible for use with boxes even having extremely limited transversal dimensions.

Accordingly, the present invention achieves this aim with a covering machine as described in the claims herein.

BRIEF DESCRIPTION OF THE DRAWINGS

The technical features of the invention, in accordance with the afore-mentioned aims, are clearly indicated in the claims herein and the advantages of the invention are more apparent in the detailed description which follows, with reference to the accompanying drawings, which illustrate a preferred embodiment by way of example only and without limiting the scope of the invention, in which:

DESCRIPTION OF THE PREFERRED EMBODIMENTS

With reference to the accompanying drawings, the numeral 1 denotes as a whole a covering machine for packing boxes.

Figure 1:
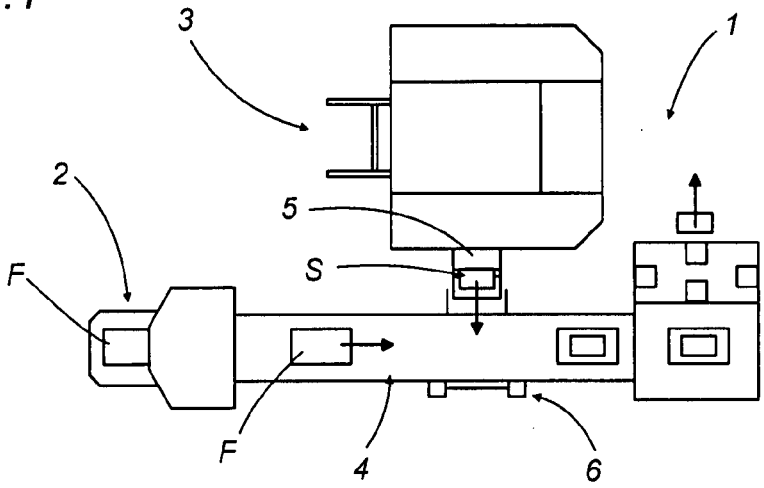
FIG. 1 is a plan view of a box production line including the covering machine in accordance with the present invention.

The covering machine can be used in a covering line of the type illustrated in FIG. 1, which schematically indicates a unit 2 for gluing covering sheets "F" and a unit 3 for erecting the boxes "S" to be covered.

The sheets "F" and the boxes "S" are conveyed by respective belts 4, 5 which converge in a joining station 6 from which a succession of boxes "S" positioned on top of sheets "F" on which glue has already been applied are moved to the covering unit 1.

The movement of the box "S" and the sheet "F" is of the conventional type and therefore is not described in further detail.

Figure 2:
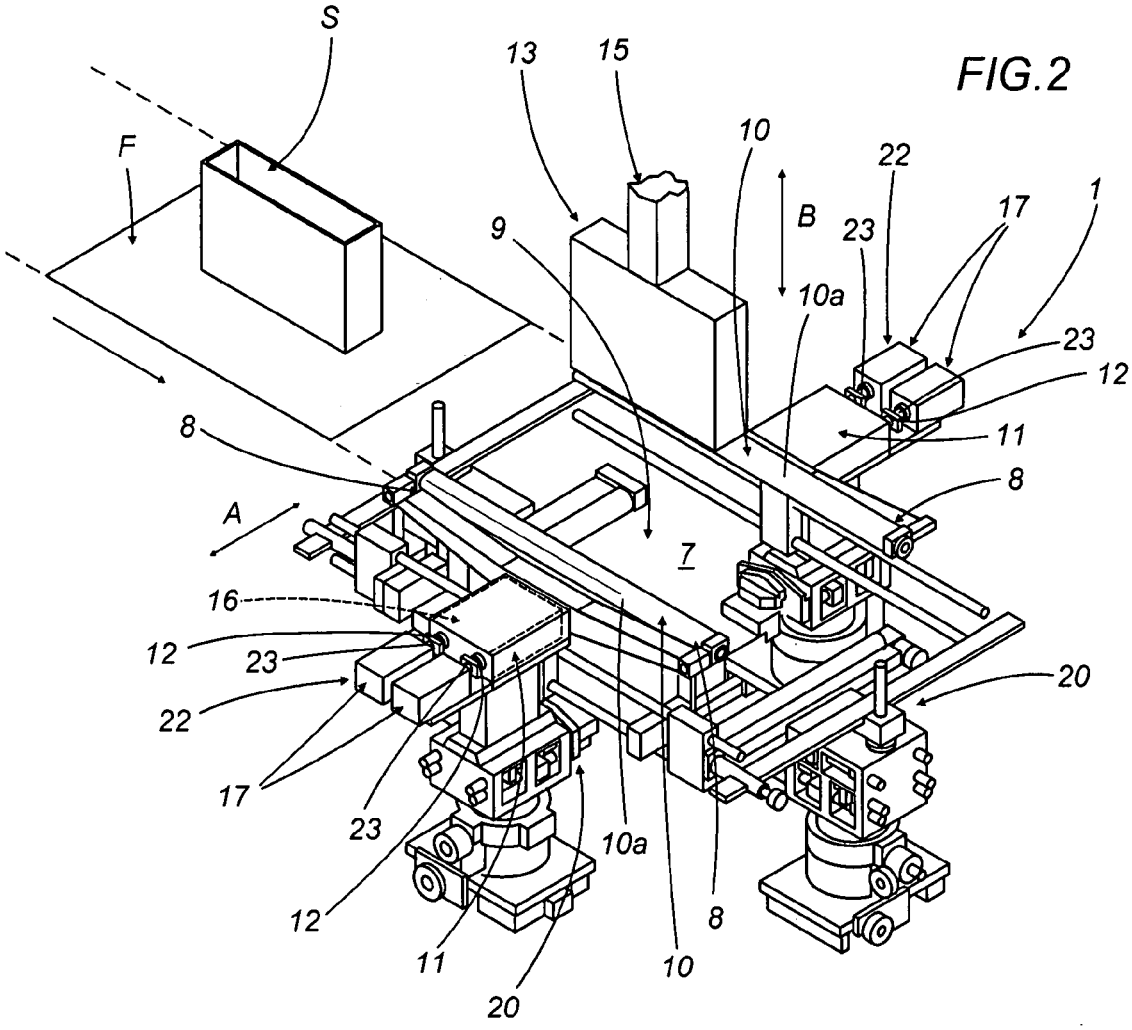
FIG. 2 is a schematic perspective view of the covering machine for packing boxes in accordance with the present invention.

FIG. 2 schematically illustrates the functional components of a covering unit 1 in accordance with the invention.

Figure 3:
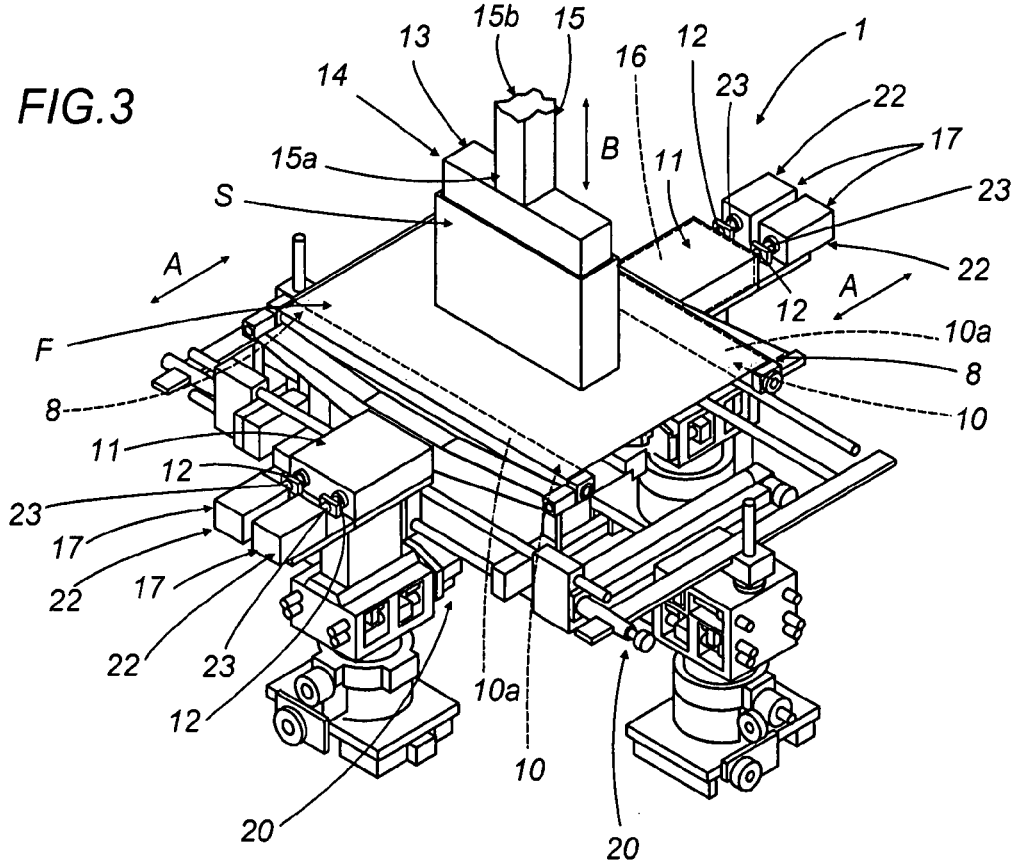
FIG. 3 is a perspective view of the covering machine of FIG. 2 during a first step of covering a box.
Figure 4:
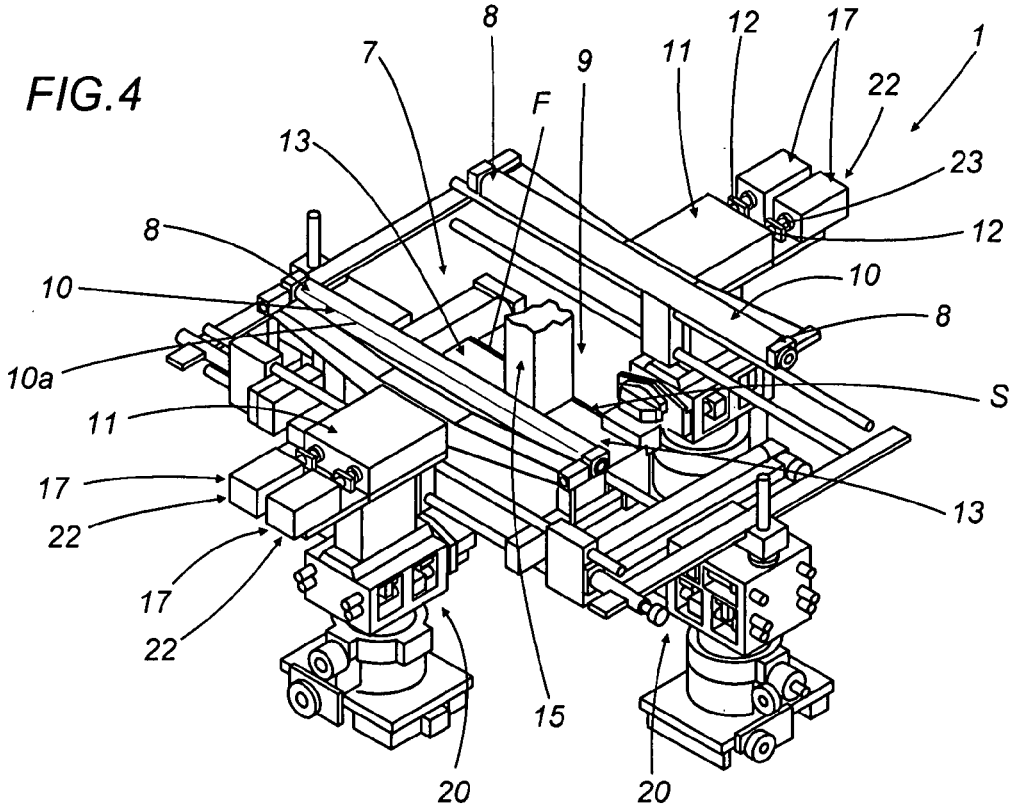
FIG. 4 is a perspective view of the covering machine of FIG. 2 during a second step of covering a box.
Figure 5:
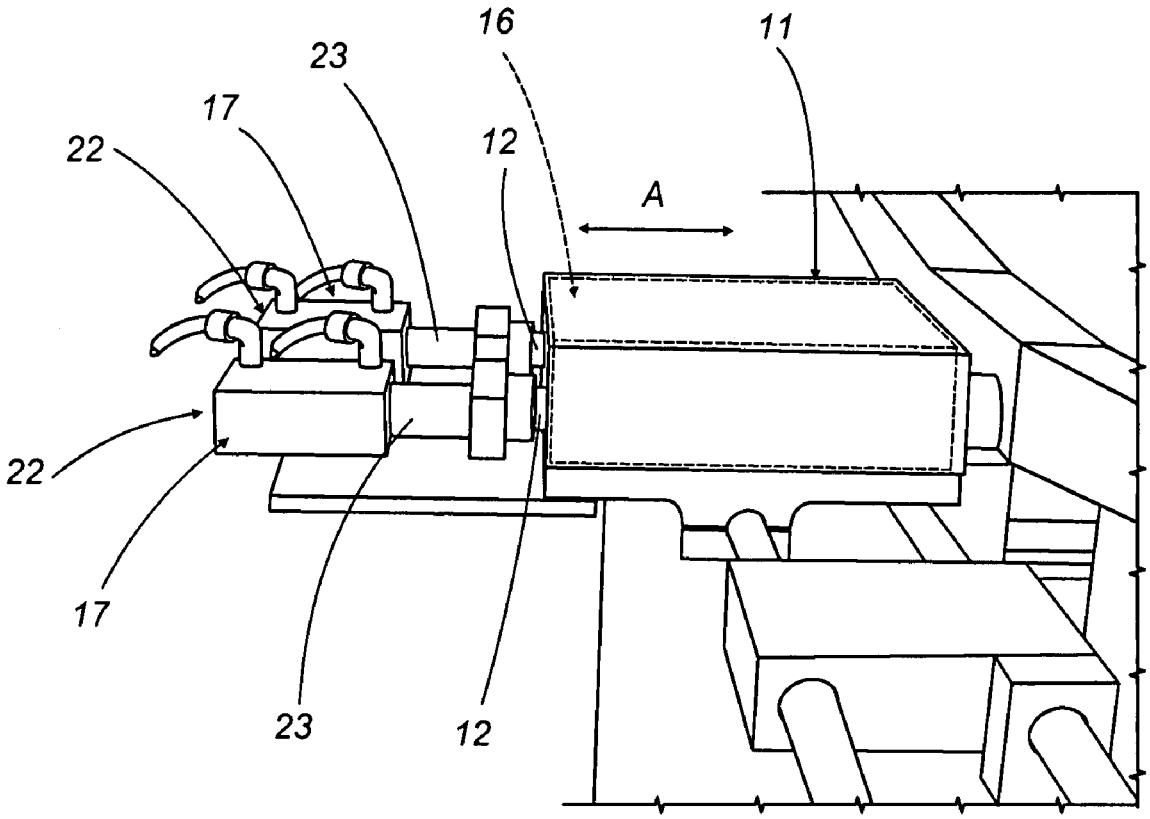

The covering machine 1 has a cavity for receiving a box "S" joined to the respective covering sheet "F", as illustrated in FIGS. 3 and 4.

It should be noticed that the accompanying drawings illustrate a box "S" having the shape of a parallelepiped placed in a central position on the sheet which is schematically indicated with "F". However, the present invention may be used for boxes "S" and sheets "F" having any suitable shape and size.

For example, if the box "S" and the sheet F have four lateral walls/faces, the cavity 7 will have four edges 8, each of which may be associated with a respective wall of the box "S", to form an access opening 9 below which the cavity 7 extends.

In this situation, widely used, a first pair of edges 8 is positioned above a second pair of edges 8 extending perpendicularly to the first pair.

In more detail, with reference to FIG. 3, the forming cavity 7 has two outer edges 8 opposite one another and able to be associated with an outer surface of the sheet "F" to make the sheet "F" adhere to the respective opposite walls of the box "S".

Again with reference to the embodiment illustrated in the accompanying drawings, each edge 8 consists of a roller 10, having a cylindrical surface 10*a* which can be abutted to the outer surface of the covering sheet.

Alternatively, the edges 8 may consist of two brushes (not illustrated in the accompanying drawings) which can be abutted to the outer surface of the covering sheet "F" and each of which has a main longitudinal extension corresponding to the wall of the sheet to which they are drawn near.

Both the rollers 10 and the brushes are parallel with one another and supported by guides or shafts 12 sliding in supports 11 parallel with a horizontal direction "A" perpendicular to the longitudinal extension of the brushes and to the axis of rotation of the rollers 10.

The covering machine 1 also has vertical stroke means 13 illustrated in FIGS. 3 and 4, which can be associated with the box "S" and can move with a first, downward stroke in which they push the box "S" and the respective sheet "F" into the forming cavity 7 and a second, upward stroke out of the cavity 7.

The vertical stroke means 13 advantageously consist of a mould 14 having the same profile and internal dimensions as the box "S" and which can be inserted in the box "S". The mould 14 is supported by an arm 15 extending vertically above the cavity 7 and having a lower end 15*a* associated with the mould 14 and an upper end 15*b* opposite the lower end 15*a* and suitably connected to respective movement means which are known and therefore not described and illustrated in further detail.

The arm 15 is illustrated as having a rectangular shape to show the relative longitudinal and transversal dimensions, but it shall be understood that the arm may have a different shape, for example cylindrical.

It should be noticed that the mould 14 may be substituted and mounted on the arm 15 according to the dimensions of the box "S" to be used. In this context, if small boxes "S" must be covered, the cross-section dimensions of the mould 14 are smaller than the cross-section dimensions of the arm 15.

In operation, the arm 15 moves the mould 14 along a vertical direction "B" to insert the box "S" in the cavity 7, perform the downward covering stroke and then the vertical stroke for extracting the covered box from the mould 14.

In more detail, with the vertical stroke means 13 in the first position the mould 14 is inserted in the box "S" and it is pushed below the edges 8. In this situation, the box "S" and consequently also the mould 14 is made to pass through the opening 9 into the cavity until the arm 15 is positioned in the access opening 9 (FIG. 4). During this movement the flaps of the sheet "F" are folded over the walls of the box "S" and made to adhere to them.

Then, the arm 15 performs an extraction of an upper section of the mould, called the counter-mould, from the box S followed by a limited downward movement of the counter-mould to fold the projecting flaps of the sheet over the edges of the box in combination with sheet flap folding elements 20, of the known type and not part of the specific subject matter of the present invention.

Once this folding over is complete, the arm 15 returns to its position above the cavity 7, returning the mould to its starting position and allowing extraction of the covered box "S".

The covering machine 1 also comprises first means 16 for moving the rollers/brushes 10 towards/away from the box "S".

In particular, the movement means 16 are associated with the supports 11 and move the edges 8 along the horizontal direction "A" towards one another (FIG. 3) so that they make contact with the outer walls of the box "S", and away from one another so that they are moved away from the walls of the box "S" (FIG. 4).

In this way, with the vertical stroke means 13 in the first position in which they push the box "S" into the cavity 7, the rollers 10 are moved towards one another into a contact position in which they are drawn near the walls of the box when the box is at the access opening 9, whilst they are moved away from one another into a detached position when covering is complete.

Advantageously, according to the invention there are second horizontal movement means 22 comprising at least one actuator schematically indicated with 17 and preferably two linear actuators 17, each associated with a respective shaft 12 to move it along the horizontal direction "A". Said second horizontal movement means 22 includes an actuator element for controlling an alternating motion of a shaft 23 fixed to one end of the shaft 12 by fixing means.

Each support 11 is preferably joined to two actuators 17 each of which consists of a pneumatic piston for making the shafts 12 slide with a to and fro motion.

The actuators 17 are also connected to one another by suitable control means, of the known type and therefore not illustrated and described, which move the actuators 17 of each carriage 11 in a synchronized way according to the stroke of the vertical stroke means 13.

Advantageously, the presence of the secondary actuators 17 allows the rollers 10 to be rapidly moved backwards as soon as they have covered the respective walls of the box and the mould 14 and the arm 15 must continue the downward stroke to cover the short walls or to fold over the covering sheet.

Consequently, thanks to the invention it is possible to cover a box which even has a very limited width in automated covering machines, even pre-existing ones, designed for a minimum width equal to the dimensions of the arm 15.

Moreover, the covering machine 1 advantageously has an extractor element which can engage the covered box "S" to detach it from the mould 14.

The invention described is susceptible of industrial application and may be modified and adapted without thereby departing from the scope of the inventive concept. Moreover, all details of the invention may be substituted by technically equivalent elements.

What is claimed is:

1. A covering machine for applying a covering sheet onto a packing box, said machine comprising:

(a) a first pressure element defining a first edge of a covering cavity for receiving a box coupled to a covering sheet, (b) vertical stroke means for moving the box and the respective sheet into the cavity, said vertical stroke means comprising (1) a mould having external dimensions corresponding to internal dimensions of the box and (2) an arm coupled to and extending upward from the mould, said arm having a lower end, said mould being configured to be inserted into the box, (c) first means for moving the first pressure element horizontally a predetermined distance towards a path of the box effective to permit the covering sheet to be pressed against a first vertical wall of the box by the first pressure element along with downward movement of the box, and (d) second means for moving the first pressure element horizontally a predetermined distance away from the box after the first pressure element has finished pressing the covering sheet against the first vertical wall of the box but before the lower end of the arm passes the first pressure element as the lower end of the arm continues downward past the first pressure element, so that the first pressure element will not interfere with the lower end of the arm when the lower end of the arm extends horizontally beyond the first vertical wall of the box towards the first pressure element, said second means for moving being distinct from said first means for moving.

2. The covering machine of claim 1, wherein said first pressure element is a roller or a brush.

3. The covering machine of claim 1, wherein said first pressure element is a roller.

4. The covering machine of claim 1, further comprising (a) a second pressure element which defines a second edge of the covering cavity opposite said first edge, (b) third means for moving the second pressure element horizontally a predetermined distance towards the path of the box effective to permit the covering sheet to be pressed against a second vertical wall of the box by the second pressure element along with downward movement of the box, and (c) fourth means for moving the second pressure element horizontally a predetermined distance away from the box after the second pressure element has finished pressing the covering sheet against the second vertical wall of the box but before the lower end of the arm passes the second pressure element as the lower end of the arm continues downward past the second pressure element, so that the second pressure element will not interfere with the passage of the lower end of the arm when the lower end of the arm extends horizontally beyond the second vertical wall of the box towards the second pressure element.

5. The covering machine of claim 4, wherein each of said first, second, third and fourth means for moving comprises a linear actuator.

6. The covering machine of claim 1, wherein said second means for moving comprises a linear actuator.

7. The covering machine of claim 1, wherein said second means for moving comprises a pneumatic actuator.

8. The covering machine of claim 1, wherein said second means for moving comprises a cam mechanism acting on a shaft to move the first pressure element horizontally.

9. The covering machine of claim 1, wherein said mould has a longitudinal horizontal dimension extending in a first direction and a transverse horizontal dimension extending in a second direction, and wherein the horizontal dimension of the lower end of the arm in the second direction is greater than the mould transverse horizontal dimension and wherein the lower end of the arm extends horizontally in the second direction beyond both sides of the mould.

* * * * *